United States Patent [19]
Blacker et al.
[11] 4,058,753
[45] Nov. 15, 1977

[54] ELECTRON GUN HAVING AN EXTENDED FIELD BEAM FOCUSING AND CONVERGING LENS

[75] Inventors: Allen P. Blacker, Hoffman Estates; James W. Schwartz, Deerfield, both of Ill.

[73] Assignee: Zenith Radio Corporation, Glenview, Ill.

[21] Appl. No.: 666,858

[22] Filed: Mar. 15, 1976

Related U.S. Application Data

[63] Continuation-in-part of Ser. No. 494,123, Aug. 2, 1974, Pat. No. 3,995,194.

[51] Int. Cl.[2] ..... H01J 29/70; H01J 29/76
[52] U.S. Cl. ..... 315/368; 315/13 C; 315/16; 313/449
[58] Field of Search ..... 315/15, 16, 31 R, 31 TV, 315/13 C, 382, 368; 313/449

[56] References Cited

U.S. PATENT DOCUMENTS

| | | | |
|---|---|---|---|
| 2,931,937 | 4/1960 | Dufour | 315/16 |
| 2,971,118 | 2/1961 | Burdick | 313/449 |
| 3,411,029 | 11/1968 | Karr | 313/463 |
| 3,800,176 | 3/1974 | Gross et al. | 315/13 C |

*Primary Examiner*—Maynard R. Wilbur
*Assistant Examiner*—T. M. Blum
*Attorney, Agent, or Firm*—Ralph E. Clarke

[57] ABSTRACT

This disclosure depicts an electron gun for use in a color cathode ray tube of the small neck, shadow mask-type. The gun includes an extended field lens for generating a cluster of electron beams converged and individually focused at the screen of the tube. Three main focus lens means are situated on lens axes which are mutually parallel and parallel to a gun central axis. At least two of the lens axis are off-axis with respect to the gun axis. The focus lens means has for each beam at least three electrodes including a focus electrode for receiving a variable potential for electrically adjusting the focus of the beam. In succession down-beam, there are at least two associated electrodes having potentials thereon which forms in the gaps between adjacent electrodes significant main focus field components. To adjust beam focus, the strength of a first of these components is controlled by adjustment of the voltage received by the focus electrode. The strength of the second of the field components is relatively less than that of the first component. Each of the lens means is characterized by having addressing faces of the associated electrodes which define the second field component being so structured and disposed as to cause the second field component to be asymmetrical and effective to significantly divert the beam from its path in convergence of the beams without any significant distortion of the beam and substantially independently of any beam-focusing adjustments of the first field component.

11 Claims, 7 Drawing Figures

ELECTRON GUN HAVING AN EXTENDED FIELD BEAM FOCUSING AND CONVERGING LENS

CROSS-REFERENCES TO RELATED APPLICATIONS

This application is a continuation-in-part of copending application Ser. No. 494,123 filed Aug. 2, 1974, now U.S. Pat. No. 3,995,194 having common ownership herewith.

This application is related to but in no way dependent upon, copending applications of common ownership herewith including Ser. No. 649,630 filed Jan. 16, 1976; Ser. No. 642,049 filed Dec. 18, 1975 (now U.S. Pat. No. 4,032,811 issued June 28, 1977); Ser. No. 694,614 filed June 10, 1976; Ser. No. 655,592 filed Feb. 5, 1976.

BACKGROUND OF THE INVENTION

This invention relates generally to an improved electron gun for television receiver cathode ray tubes, and is specifically addressed to an improved focus lens electrode structure that provides beam convergence substantially independently of any beam-focus-related adjustments in the main focusing fields and without inducing significant beam distortion. This invention has applicability to guns of many types and constructions, but is believed to be most advantageously applicable to three-beam unitized electron guns for color television cathode ray tubes.

Unitized electron guns for color cathode ray tubes generate three electron beams developed by cathodic thermionic emission. The resulting beams are formed and shaped by a tandem succession of electrodes spaced along the central axis of the gun. The electrodes cause the beams to be focused on multiple phosphor groups located on the faceplate of the containing color cathode ray tube. A prime objective in the design of such guns is to provide small electron beam spot size with enhanced picture resolution even at high beam currents.

Primarily for cost reasons, the current trend in color television receiver design is toward color tubes with in-line guns and stripe screens. Such tubes permit substantial simplification of convergence-related tube hardware and receiver circuitry. Gun unitization; i.e., the use of common structures for different gun parts, permits further economies.

The three electron beams of an in-line gun lie side-by-side in the same plane. The inner beam proceeds on a straight line path down the center axis of the gun and through the gun toward its landing point on the phosphor-bearing faceplate of the cathode ray tube. The two outer beams, however, which are desirably (for space economization) parallel to the center beam, must be diverted inwardly, that is, from the straight line paths at some point within the gun so that they converge at a landing point common with the inner beam. This converging of the two outer beams must be accomplished without distorting the beams. If the beams are distorted (assuming them to be initially circular in cross-section), they will no longer be circular in cross-section at the point of landing, but elliptical.

Prior art structures for converging electron beams have relied upon a variety of techniques such as the use of magnetic influences within and/or without the tube envelope, and the use of electrostatically charged plates. Also, the prior art shows many examples of inducing beam diversion or convergence by inducing an asymmetry in an electrostatic field formed at the interface of two spaced electrodes. Such an asymmetrical electrostatic field appears to have invariably induced a distortion in the shape of the beam with resulting reduced picture resolution. Prior art techniques for inducing electrostatic field asymmetry having included offsetting the opposing faces of two electrodes, slanting one or more of the opposing faces, or shaping the opposing faces so that the space lying between is in the form of a wedge. The result has been an inevitable distortion of the beam — a result which is more or less tolerable depending upon the standard of picture quality accepted.

A simple means to effect beam convergence in multiple beam guns is by simply physically tilting each gun so that all beams fall upon a common point of convergence. This has been a common practice in delta-configured guns used in large neck cathode ray tubes because the space is available for such tilting. Also, the triangular configuration makes optimum use of the cylindrical space available in the tube neck.

This simple means of obtaining convergence by tilting the guns is not feasible for in-line guns however by virtue of the fact that the guns lie side-by-side, and thus do not make as effective use of the available neck space. Also, the neck space problem has been exacerbated through the years in that as beam deflection angles have increased, the available space within the neck of cathode ray tubes has been diminished. As an example of this trend, the in-line unitized gun that is the subject of this disclosure has an outside diameter of less than an inch. As a result of this space restriction, it is inconvenient to tilt the guns to achieve convergence, so convergence must be accomplished by other means.

As will be described hereinafter, this invention concerns an electron gun having improved electrostatic beam diversion structure — especially a three-beam gun for color cathode ray tubes having improved structure for accomplishing beam convergence.

As mentioned, the prior art shows many examples of electrostatic beam diversion or convergence structures. U.S. Pat. No. 3,889,146, for example, teaches a convergence system for a delta-configured three-beam color cathode ray tube electron gun, in which beam-passing apertures of a focusing grid are made larger and are radially offset from the apertures of a preceding grid to effect convergence of the three beams.

A structure for electrostatic beam convergence in a unitized, in-line electron gun having a bipotential lens is described in U.S. Pat. No. 3,873,879. Beam focusing is accomplished by the provision of a large potential difference at the gap between the two focus grids. Convergence of the two outer beams toward a common landing point with an inner beam is accomplished by the outward offsetting of two outer beam apertures of the second focus lens grid relative to the beam path. This outward offsetting of the apertures produces asymmetrical focusing fields which cause the outer electron beams to be converged. To compensate for elliptical distortion of the outer beams caused by the asymmetrical converging-focusing field, a concavity is provided in the face of the down-beam grid.

German Patent No. 2,406,443 shows a beam convergence scheme for an electron assembly having three discrete guns. Each gun has a bipotential electron lens. The off-axis lenses have opposed end faces on either or both the focusing electrode and the anode which are inclined relative to the axis of the gun assembly to cause the beams to converge. In passing through such a structure, beam shape is said to be altered from round to elliptical, causing astigmatism (marginal blur) of the beams so diverted. The alleged invention in that patent lies in providing elliptically shaped electrode apertures to neutralize the ellipticity of the beams.

In U.S. Pat. No. 2,957,106, a system of beam convergence is recited wherein beams are caused to converge at the low-voltage (cathode) end of a bipotential electron gun. In one embodiment, the beam apertures are offset radially. In another, the opposing faces of two adjacent electrodes in the low-voltage area are caused to have a similar angle (as shown by FIG. 5 of the cited disclosure), and the convergence attained is a function of electrode face angle and the relative potential of the two electrodes.

The disadvantages believed to be inherent in the U.S. Pat. No. 2,957,106 system are three-fold: (1) convergence of beams by passing them through an asymmetrical field early in their travel through the gun results in substantial and largely irremediable astigmatism; (2) such early convergence makes manufacture of multibeam guns extremely difficult in that the beam channels of electrodes that follow the convergence electrodes must also tilt inwardly, and the faces of all succeeding electrodes must be slanted so as to be perpendicular to the axis of each beam to avoid further distortion of the beam. This inward tilting is progressive, and results in a physical "squeezing" of the components in the progression of the components from the point of convergence to the end of the gun. Such squeezing results in a progressive decrease in barrel lens diameter and hence in increased spherical aberration.

Also, the ever-closer adjacency of the gun parts encourages beam-to-beam interaction, especially in an aperture lens configuration. Thirdly, there is an interaction between focus and convergence. The convergence means is focus-voltage-sensitive and G2 voltage-sensitive so that the resulting angle of convergence is susceptible to gun-to-gun focus voltage differences due to constructional variations and G2 voltage variations, and also due to gun-to-gun variations in the cathode-to-G2 spacing. The resulting range of misconvergence values due to focus voltage and G2 voltage variation in manufacture of the cited convergence method could be quite large depending upon the actual design values of focus voltage and G2 voltage. Further, the approach taught in the cited disclosure is not believed to be amenable to unitization.

Beam convergence can also be accomplished by means of post-focus electrostatic or magnetic convergence plates placed parallel to the beam travel. Or, magnetic pole pieces adjacent to the beams at the emission end of the gun can exert a converging influence on passing beams. Such approaches, however, add cost, lengthen the gun (and thus the cathode ray tube), and are apt to distort the beams.

Other Prior Art

| Beam Diversion by Asymmetric Field | Beam Convergence by Asymmetric Field |
|---|---|
| U.S. 2,496,127 | U.S. 3,889,146 |
| U.S. 2,638,559 | U.S. 3,890,528 |
| U.S. 2,792,515 | German 2,500,818 |
| U.S. 2,884,551 | German 2,358,896 |
| U.S. 2,911,563 | |

Convergence by Plate Structure or Pole Pieces Separate from the Focus Lens

-continued

| | |
|---|---|
| U.S. 2,849,647 | U.S. 3,866,080 |
| U.S. 3,571,645 | U.S. 3,579,008 |
| U.S. 3,614,500 | |
| U.S. 3,614,501 | |
| U.S. 3,619,687 | |
| U.S. 3,678,318 | |

OBJECTS OF THE INVENTION

It is a general object of this invention to provide an improved electron gun for a color television cathode ray tube, especially a three-beam gun for a small neck, shadow-mask-type color tube.

It is a less general object to provide in such a gun an impoved focus lens structure capable of effecting electrostatic convergence of off-axis beams substantially independently of any beam-focus-related focusing field adjustments and without producing any significant distortion of the beams.

It is a further object to provide such a gun which lends itself readily to unitization and to mass manufacture.

BRIEF DESCRIPTION OF THE DRAWINGS

The features of the invention which are believed to be novel are set forth with particularity in the appended claims. The invention, together with objects and advantages thereof may best be understood, however, by reference to the following description taken in conjunction with the accompanying drawings, in which the several figures of which like reference numerals identify like elements and in which:

DESCRIPTION OF THE PREFERRED EMBODIMENT

Whereas the present invention can be embodied in electron guns of several different types, both unitized and non-unitized, a number of preferred gun embodiments of the principles of this invention are illustrated in FIGS. 1–7. The illustrated gun embodiments happen to all be of unitized construction since unitized types of electron guns offer many advantages over other types in common use for color cathode ray tubes. Advantages include the fact that the gun has fewer parts, and a "unitizing" of the control grid and accelerating grid results in fewer connections and circuits.

In a broader sense, however, this invention may be applied even to a single beam gun wherein it is desired to deflect or divert the beam from its main axis. In the context of a multibeam color cathod ray tube gun assembly, this invention may be employed to converge the off-axis beams to a common location on the screen. In an in-line gun (unitized or non-unitized) wherein one beam is coaxial with the central axis of the gun assembly, the teachings of this invention may be employed to effect convergence of the off-axis (outer) beams. In a delta-configured gun assembly (unitized or non-unitized), this invention may be employed to divert all three beams such that they converge at a common point on the screen.

As noted, because of the cost economies possible with in-line guns, and also with guns of unitized construction, the illustrated preferred execution of the invention is a unitized in-line type gun.

Figure 1:
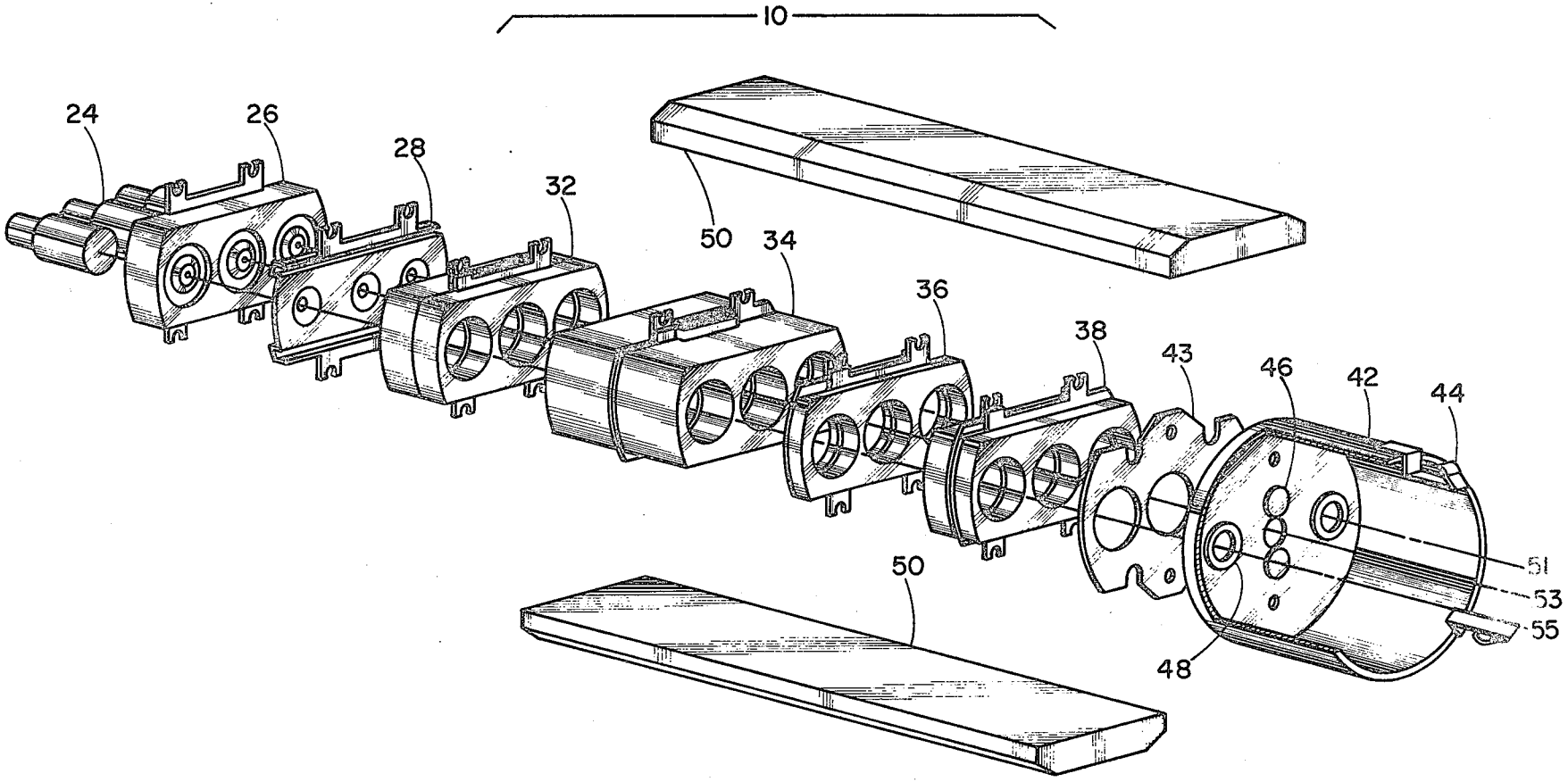
FIG. 1 is an exploded view in perspective of the components of a color cathode ray tube unitized, in-line gun having certain focus electrodes constructed in accordance with this invention.
Figure 2:
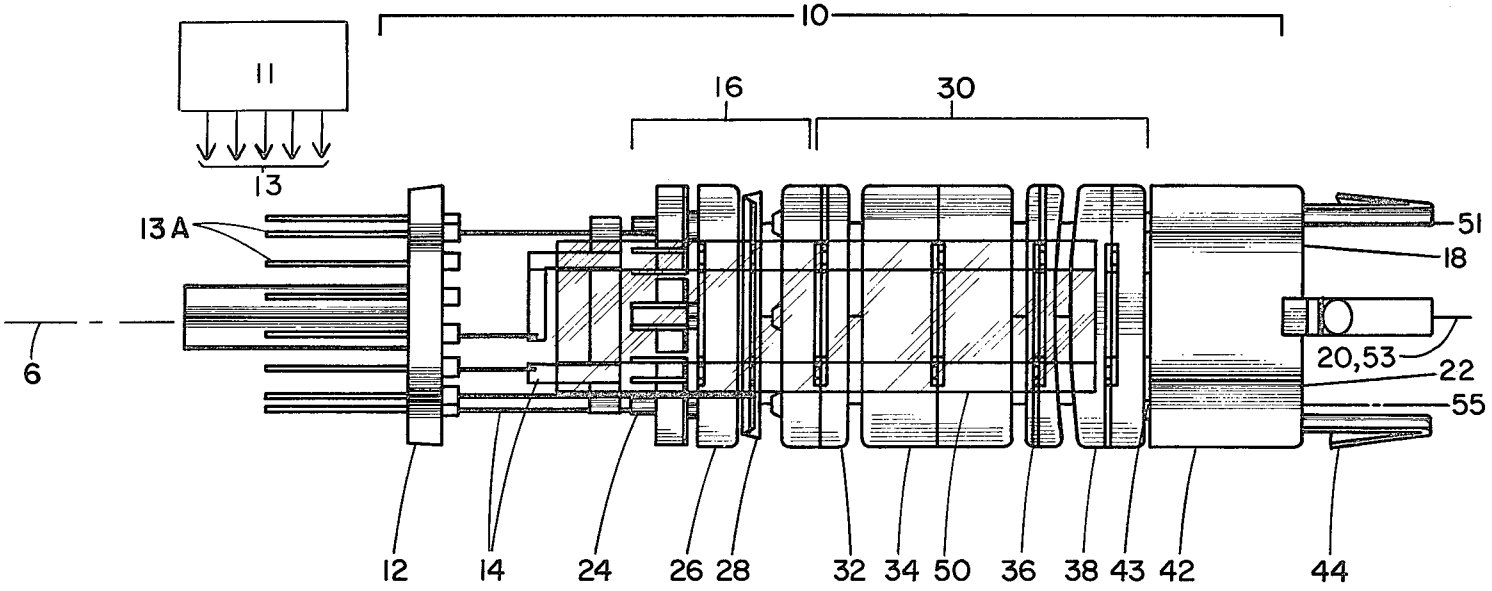
FIG. 2 is an assembled top view of the gun shown in FIG. 1.
Figure 3:
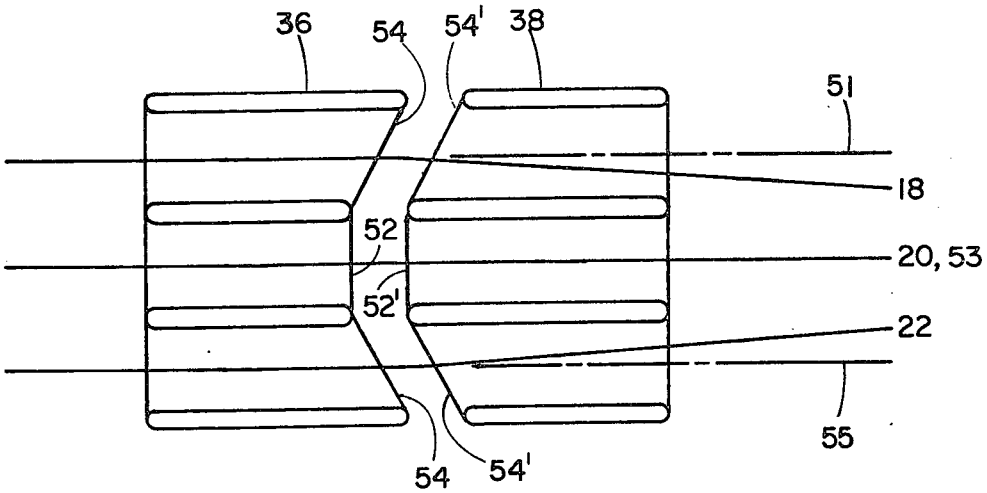
FIG. 3 is a schematic representation of the plano-parallel addressing faces of two electrodes angled forwardly and outwardly to form an asymmetric field.

FIG. 1 is an exploded view in perspective and FIG. 2 an assembled view of a unitized, in-line type of electron gun 10 for use in a color television cathode ray tube, which gun incorporates the present invention. The unitized, in-line gun is especially suited to use in small-necked, shadow-mask type cathode ray tubes. As is well known in the art, the electron gun structure for a cathode ray tube is located at the base of the tube in the narrow neck region opposite the faceplate.

The illustrated embodiment is an in-line type gun, generating three coplanar electron beams each of which is formed, shaped and directed to selectively energized phosphor elements located on the imaging screen in the expanded area at the opposite end of the cathode ray tube envelope (not shown).

Referring to FIGS. 1 and 2, the gun 10 is illustrated as having a central axis 6; a cathode ray tube base 12 provides a plurality of lead-in pins 13A for introducing into the glass envelope the video signals, as well as certain voltages for beam forming and focusing. A power supply 11, illustrated schematically, develops a predetermined pattern of relatively low, relatively intermediate, and relatively high supply voltages for application to the main focus lens components of the gun 10, as will be described. Power from power supply 11 is provided to electron gun 10 through a plurality of external electrical leads 13 routed through the lead-in pins **13*a* of base 12. The operating signals and voltages are conveyed to the several electrodes of gun 10 within the glass envelope by means of several internal electrical leads; typical leads are shown by 14**.

The gun 10 has a tetrode section 16 which generates three separate beam cross-overs (not shown), one for each of three beams 18, 20 and 22 (red-associated, blue-associated and green-associated). The tetrode 16 is comprised of four parts: separate cathodes 24 for each beam, a common control electrode 26 ("G1"), a common disc-type accelerating electrode 28 ("G2"), and a part of a common electrode 32 ("G3"); that is, the "lower end", or the end nearest the cathode. The tetrode section does not constitute, per se, an aspect of this invention, but is described and claimed in the referent copending application Ser. No. 694,614.

The beam cross-overs are imaged on the screen of the cathode ray tube by respective main focus lens means. As will be described in more detail below, in the illustrated FIGS. 1–4 embodiment, the main focus lens means for the three beams 18, 20 and 22 are unitized and constituted by the upper end section of common main focus electrode 32 and common main focus electrodes 34, 36 and 38. Each of these electrodes 32, 34, 36 and 38 is electrically isolated from the others and receives predetermined voltages from the power supply 11 to form a single extended main focusing field. The function and operation of the main focus lens means, and their relation to beam convergence, is the subject of a more detailed discussion in following paragraphs. In this specification, the collection of unitized common main focus electrodes 32, 34, 36 and 38 are termed the "main focus lens" 30 of the gun 10. The term "main focus lens means" refers to the focus lens structures employed to focus a single beam. The term "main focus electrode means" refers to a discrete individual focus electrode for a single beam, or an allotted portion of a unitized electrode common to other beams.

Further with reference to FIGS. 1 and 2, the last in the series of elements that comprise electron beam gun 10 is support cup 42. Support cup 42 provides a mounting base for three contact springs 44 which center the forward end of the gun in the neck of the cathode ray tube. Also, by contact with an electrically conductive coating on the inside of the neck of the tube, which is maintained at screen voltage, contact springs 44 convey the screen voltage through support cup 42 to electrode 38 of the main focus lens 30. Located within the cavity formed by the support cup, and adjacent to the apertures from which the three electron beam 18, 20 and 22 emerge, are enhancer magnets 46 and shunt magnets 48.

Support cup 42 is aligned and bonded to electrode 38 in precise registration by means of a carrier plate 43 which lies between the cup and electrode. The carrier plate 43 and its associated cup mounting method does not constitute, per se, an aspect of this invention, but is described and claimed in the referent copending application Ser. No. 649,630.

In the unitized, in-line gun described in this disclosure, the common electrodes 26, 28, 32, 34, 36 and 38 have on each side thereof at least one pair of widely spaced, relatively narrow claws embedded at widely spaced points in a wide bead 50. This claw and bead concept does not constitute, per se, an aspect of this invention but is described and claimed in U.S. Pat. No. 4,032,811.

As noted, except for the three cathodes 24, the individual electrodes are "unitized"; that is, they each comprise one mechanical assembly having individual apertures for the three coplanar beams 18, 20 and 22 (beams 18 and 22 being herein termed the "outer" beams, and beam 20 being herein termed the "inner" beam). The gun electrodes are further characterized by having three effectively continuous, electrically shielding beam-passing tubes extending completely through the electrodes, each tube being formed by a contiguous axial succession of deep-drawn annular lips. The beam-passing tube concept does not constitute, per se, an aspect of this invention, but is described and claimed in the referent copending application Ser. No. 655,592.

The present invention provides an improved focus lens structure capable of effecting electrostatic convergence of off-axis beams which is substantially independent of variations in the main focusing field and without producing any significant distortion of the beams.

Broadly speaking, the present invention involves electrode structuring and positioning, in conjunction with the use of an extended field lens concept which, by its characteristics makes possible off-axis beam convergence without any significant beam distortion; also, the resulting structure is not focus-voltage sensitive, nor is it seriously affected by variations in structure that may result from manufacturing processes.

The extended field focus lens concept that makes possible these benefits takes advantage of certain principles described and claimed in U.S. Pat. No. 3,895,253, assigned to the present assignee. The present invention will be best understood after an explanation of certain principles of that extended field lens concept, set forth as follows.

As pointed out in U.S. Pat. No. 3,895,253, it can be shown that lens aberrations depend largely upon the value of the line integral of the quantity $$\left[\frac{(V_O'')^2}{(V_O)^{3/2}}\right]^{r^3}$$

where $V_O$ is the axial potential distribution in the lens, $V_O''$ is the second derivative of $V_O$ and $r$ is the radial coordinate of an electron in the beam. Therefore, it follows that large values of $V_O''$ are particularly harmful in regions where the axial potential $V_O$ is low or where the beam radius is large. The $V_O''$ in the extended field lens of the U.S. Pat. No. 3,895,253 patent is substantially less over the entire lens length and is especially low in regions of low axial potential. Furthermore, the maximum values of $V_O''$ are substantially reduced.

The net result is an extended field lens in which the focusing field is spread out along the axis of the lens so that $V_O$ varies smoothly and gradually over its entire range. The desired field characteristics can be established in the paraxial region of a very large diameter lens, however, it has not been possible, it is believed, until the invention cited in the foregoing to achieve the desired field characteristics in a lens having a small diameter. It has been demonstrated that by keeping the quantity $V_O''$ as small as possible in regions where $V_O$ is small, or where the beam diameter is large, the necessary focusing power can be achieved while suppressing the total spherical aberration produced.

A second invention in extended field lenses is described and claimed in U.S. Pat. No. 3,995,194 — that invention too is exploited in the gun of the present invention. The objectives of high picture brightness (implying relatively high beam currents) and high resolution (implying relatively small focus beam spot size) are met by the inventions described in the 3,895,253 and 3,995,194 patents.

In accordance with the teachings of the afore-discussed extended field lens inventions, the main focus lens 30 for the gun 10 comprises three main focus lens means situated on lens axes 51, 53, 55 which are mutually parallel and parallel to a gun central axis 6. The outer beam focus lens means axes 51, 55 are off-axis with respect to the gun axis 6. The three main focus lens means respectively receive electrons from the three beam cross-overs (not shown) and converge the beams 18, 20 and 22 and individually focus the beam cross-overs at a common location on the tube screen. The focus lens means include for each beam, first, second third and fourth coaxial spaced main focus electrode means, here shown as constituting allotted portions of the unitized common electrodes 32, 34, 36 and 38. The first and third focus electrode means (part of electrodes 32 and 36) receive from the power supply 11 a relatively intermediate voltage. The second focus electrode means (part of electrode 34) receives a relatively low focus voltage. The fourth focus electrode means (part of electrode 38) receives a relatively high (typically screen) voltage. Each focus lens means establishes an electrostatic main focusing field characterized by having a single, continuous axial potential distribution which, in the direction of electron beam flow and at all times during tube operation, decreases smoothly and monotonically from an initial, relatively intermediate potential near said electron source means to a relatively low potential spatially located at a lens intermediate position, and then increases smoothly, directly and monotonically from said relatively low potential to a final, relatively high potential. The major focusing effect on the beam is accomplished prior to the last focusing field component, i.e., the component established between said third and fourth electrode means (parts of electrodes 36 and 38).

Figure 4:
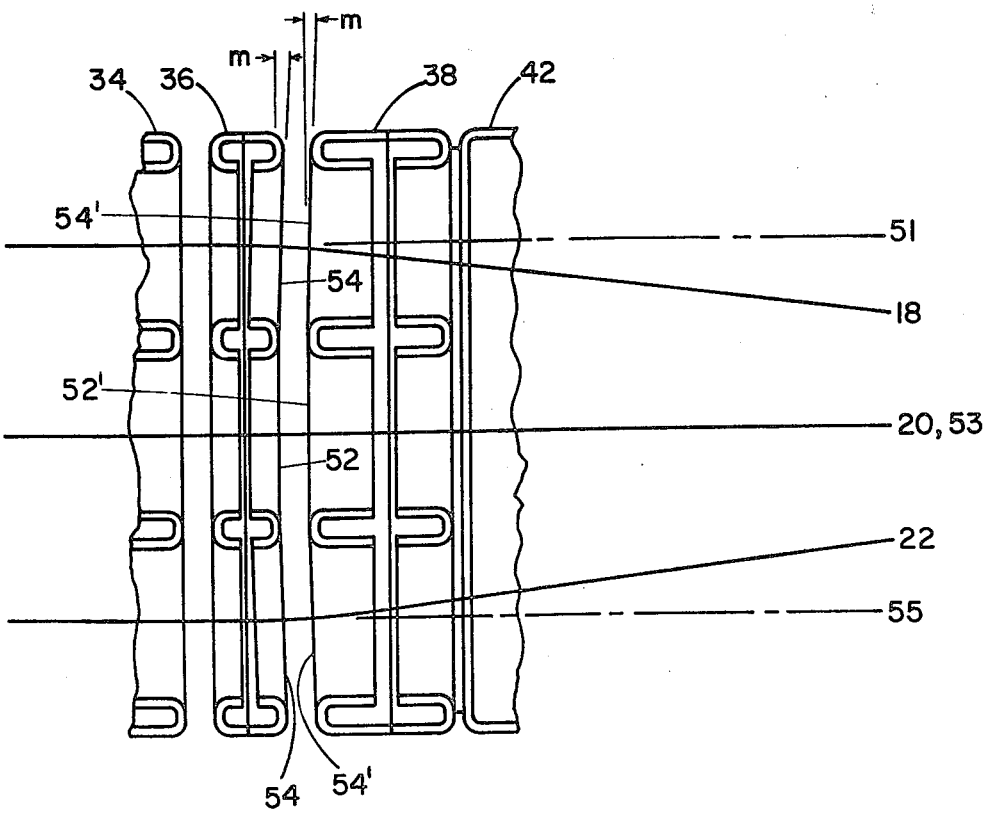
FIG. 4 is an elevational view in section showing the addressing faces of the third and fourth electrodes that are shaped to supply convergence in a unitized, in-line electron gun.
Figure 5:
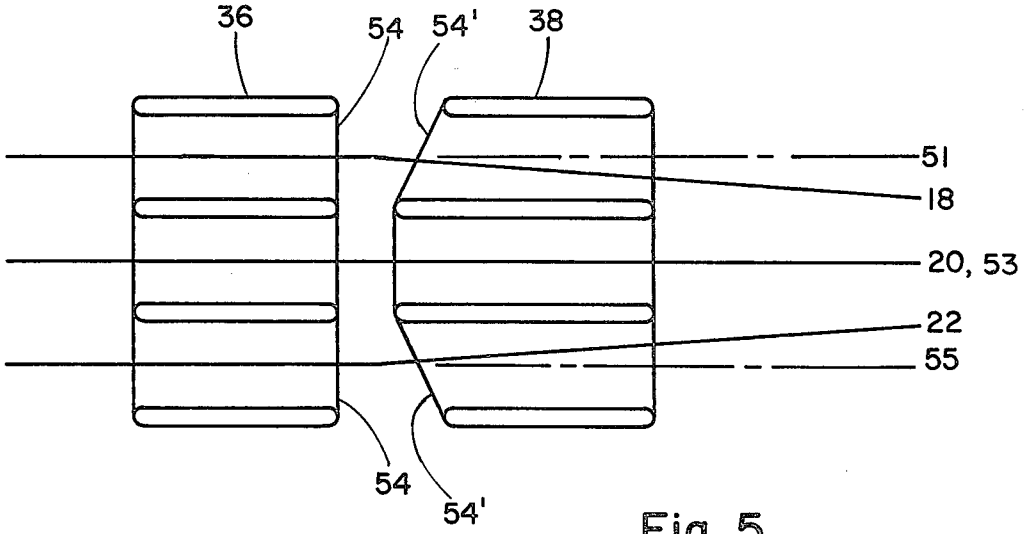
FIG. 5 is a schematic representation of wedge-shaped gaps between electrode addressing faces designed to achieve beam convergence.

The characteristics of the extended main focusing field heretofore described makes expedient the convergence means which is the subject of the present invention. The foregoing description provides a general background for the understanding of the invention and the objects thereof. In the following, the preferred embodiments of a gun having improved focus electrode structures that provide for beam convergence are described in detail. A convergence electrode structure which implements this invention is shown in schematic view in FIG. 3. The electrodes schematically represented are electrodes 36 and 38 shown in FIGS. 1 and 2 in more realistic structural form. Reference should also be had to FIG. 4 which is an enlarged view of the electrodes 36 and 38 in FIGS. 1 and 2.

In accordance with the principles of this invention, in order to effect convergence of the outer beams 18 and 22, each of the outer focus lens means has addressing faces of the third and fourth focus electrode means (the allotted portions of electrodes 36 and 38) so structured and disposed as to cause the last focusing field component to be an asymmetric field component effective to significantly divert the contained beam toward the gun axis to effect said beam convergence at the screen. Due to the nature of the extended main focusing field formed by the main focus lens means and the location in said fields of the outer focus lens means of said asymmetric focusing field components, the convergence of the beams 18, 20 and 22 is accomplished without any significant distortion of the outer beams 18 and 22 and substantially independently of any beam-focus-related adjustments in the main focusing fields of the outer focus lens means.

In the illustrated preferred embodiment, the addressing faces 52, 52' of electrodes 36 and 38 for the main focus lens means for the inner beam 20 are plano-parallel and perpendicular to the path of beam 20, with the result that the field established between these faces exerts no diverting effect upon the beam 20, but allows beam 20 to pass through undiverted to its proper point of landing on the screen.

The addressing faces 54 and 54' of electrodes 36 and 38 for the outer main focusing lens means for the outer electron beams 18 and 22 are also plano-parallel; however, the angle of their faces 54 and 54' is not perpendicular to the axes 51, 53 of the lens means, but are set at a specific angle to form a gap which is angled forwardly and outwardly to form an asymmetric focusing field component between electrodes 36 and 38. The angle and resulting asymmetrical field component causes convergence of the two outer beams 18 and 22 without any significant distortion of the beams.

It has been determined that the proper angle "*m*" of the plano-parallel faces 54, 54' of the electrodes 36 and 38 for a nineteen inch diagonal color cathode ray tube is about 3°, 12 minutes. The angle "*m*" is, of course, necessarily different for tubes of different configurations and sizes.

The following formula has been found to yield a close approximation to the value of the angle "*m*" for color tubes of common sizes and configurations. (The calculated angle may in some cases have to be slightly adjusted empirically.)

$$m = \mathrm{TAN}^{-1}\left[\frac{BB}{(Q + LG6)\left(1 - \sqrt{\frac{VG5}{VG6}}\right)}\right]$$

where *m* is the geometric angle, BB the center-to-center spacing of the beam, Q is the distance from the end of electrode 38 to the screen, LG6 is the approximate length of electrode 38, VG5 is the potential on electrode 36, and VG6 is the potential on electrode 38.

FIG. 4 is a top, cross-sectional view of a convergence structure which has been produced and successfully tested. The exemplary specifications for this structure, which comprises electrodes 36 and 38 (refer also to FIGS. 1 and 2) are as follows. The material from which electrodes 36 and 38 are made is an austenitic stainless steel AISI type 305, having a nominal thickness of 0.010 inch. The angle "*m*" of the faces that induce convergence is 3°, 12 minutes. The spacing, or gap, between the electrodes 36 and 38 is 0.040 inch, the width of electrode 36 (in an axial direction) is 0.100 inch, and the width of electrode 38 is 0.230 inch. The diameters of each of its three beam-passing apertures is 0.226 inch.

With regard to the potentials applied to each of the unitized main focus electrodes of focus lens 30 of gun 10 (refer to FIG. 2) — they may for example be: electrode 32, 12 kV; electrode 34, 7 kV; electrode 36, 12 kV; and electrode 38, 30 kV.

Means for achieving electrostatic convergence in an extended field main focus lens according to the teachings of this invention, other than the angled plano-parallel electrode addressing faces heretofore described, are contemplated. An asymmetric field component resulting in beam diversion on convergence may also be provided by setting only one of the two addressing faces 54, 54' at an angle in relation to the electron beam axis. The opposing face is not set at an angle but is perpendicular to the beam. This configuration is shown schematically by FIG. 5. The addressing faces of the two electrodes form a wedge-shaped gap which results in the creation of an asymmetric focusing field component.

Figure 6:
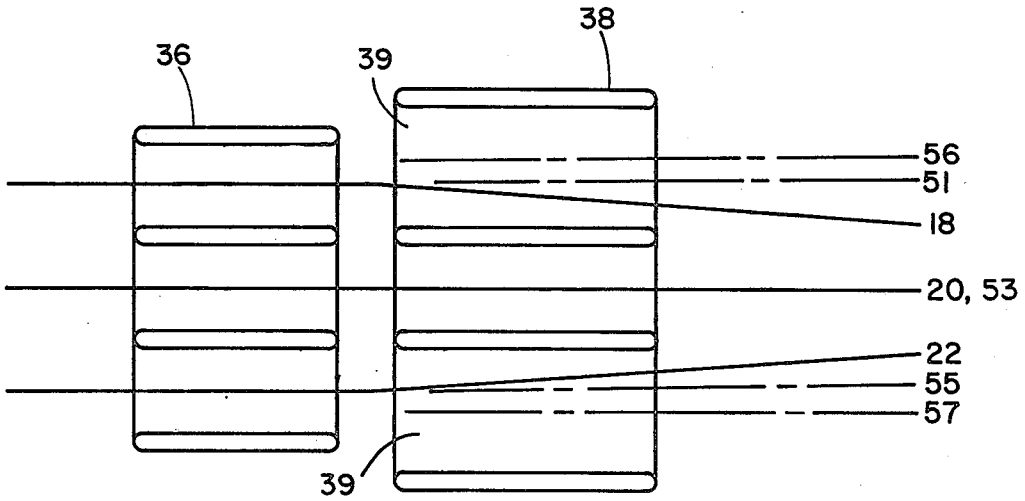
FIG. 6 is a schematic representation of electrodes having radially offset apertures designed to achieve beam convergence.

In yet another embodiment, an asymmetric focusing field component may be formed between the last two main focus lens electrodes 36, 38 by forming the faces to have radially offset apertures as shown by FIG. 6. In FIG. 6, electrode 38 has beam-passing apertures 39 for the outer beam main focus lens means which are larger than the corresponding apertures in electrode 36 and which lie on axes 56, 57 radially outwardly offset from the axes 51, 55.

The aspects of the preferred embodiment set forth in this disclosure are equally adaptable to other types of unitized electron guns than the in-line gun used as an example in the foregoing description. The invention is applicable, for example, to unitized delta-configured guns having extended field lenses of the nature described.

Figure 7:
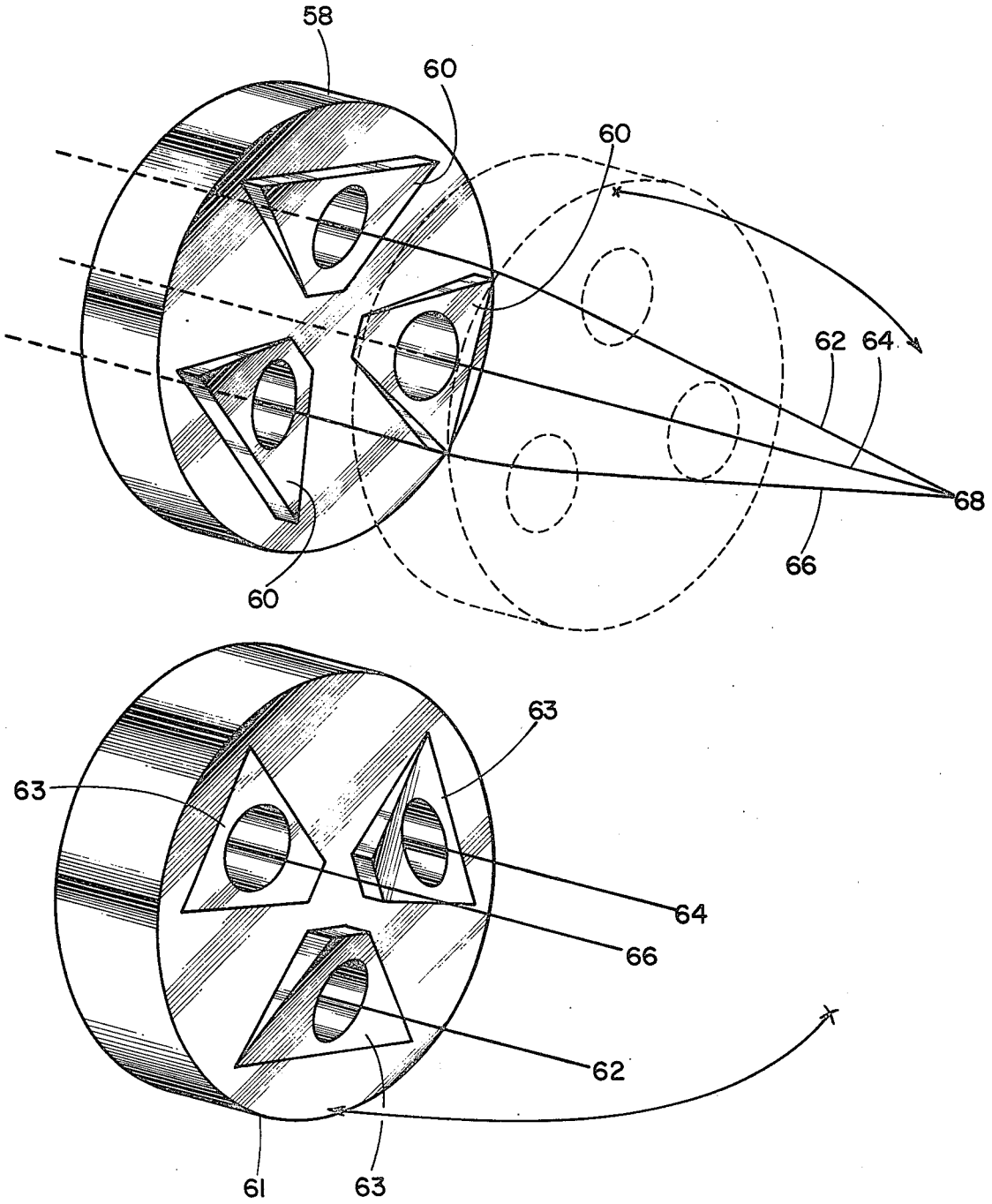
FIG. 7 is a pictorial representation in perspective of beam convergence in a three-beam delta-configured gun. Gaps between addressing faces are angled forwardly and outwardly to form asymmetrical focusing field components.

FIG. 7 depicts the last two electrodes 58, 61 of a unitized delta-configured gun having a four-electrode main focus lens according to the above-described teachings. Electrodes 58 and 61 correspond to electrodes 36 and 38 in the above-described embodiments. The gun of which the FIG. 7 electrodes 58, 61 constitute a part focus and converge three beams 62, 64, 66. Beam convergence is effected by causing addressing faces 60, 63 to be plano-parallel and angled forwardly and outwardly with respect to the gun central axis, as taught above with respect to the FIGS. 1–4 embodiment. Unlike the unitized, in-line gun 10 described in the foregoing, all three beams 62, 64 and 66 of the delta gun are caused to converge at the common point of landing 68, rather than just the two outer beams as in the case of the in-line gun.

Convergence of the three beams of the delta-configured gun may be by means other than utilizing angled, plano-parallel electrode addressing faces as described. As shown schematically by FIG. 5, the beam-diverting addressing faces may be shaped in the form of a wedge, or the apertures may be radially offset as shown by FIG. 6.

Other changes may be made in the above-described apparatus without departing from the true spirit and scope of the invention herein involved, and it is intended that the subject matter in the above depiction shall be interpreted as illustrative and not in a limiting sense.

We claim:

1. An electron gun for a television color cathode ray tube having an extended field lens for producing a focused and diverted beam of electrons, said gun having coaxially arranged electrodes comprising:

associated cathode means and grid means for producing an electron beam crossover;

a main focus lens means for receiving electrons from said beam crossover to form at the screen of the tube a real image of said beam crossover, said main focus lens means having at least three electrodes situated on a common axis including a focus electrode for receiving a variable potential for electrically adjusting the focus of said beam, and in succession down-beam, at least two associated electrodes having potentials thereon which form in the gaps between adjacent electrodes significant main focus field components, the strength of a first of which components is controlled by adjustment of the voltage received by said focus electrode, the strength of a second of which field components spaced down-beam from said first component being relatively less than that of said first component;

said lens means being characterized by having addressing faces on said associated electrodes which define said second field component being so structured and disposed as to cause said second field component to be asymmetrical and effective to significantly divert said beam from its path, whereby due to the relative weakness of said second field component and the separation of said second field component from said first field component, said diverting of said beam is accomplished without any significant distortion of the beam and substantially independently of any beam-focusing adjustments of said first field component.

2. The gun defined by claim 1 wherein said addressing faces of said associated electrodes are plano-parallel and form a gap which is angled forwardly and outwardly to form said asymmetric focusing field component.

3. The gun defined by claim 1 wherein said addressing faces of said associated electrodes define a wedge-shaped gap to form said asymmetric focusing field component.

4. The gun defined by claim 1 wherein said addressing faces of said associated electrodes have radially offset apertures effective to form said asymmetric focusing field component.

5. For use in a color cathode ray tube of the small neck, shadow mask-type having an electron gun including an extended field lens for generating in the tube neck an in-line or delta-cluster of red-associated, blue-associated and green-associated electron beams converged and individually focused at the screen of the tube, said gun comprising:

electron source means comprising associated cathode means and grid means for producing three separate beam crossovers, one for each electron beam; and three main focus lens means situated on lens axes which are mutually parallel and parallel to a gun central axis, at least two of which lens axes are off-axis with respect to the gun axis, said three main focus lens means respectively receiving electrons from said three beam crossovers and converging said beams and individually focusing said crossovers at a common location at the tube screen, said focus lens means having for each beam at least three electrodes including a focus electrode for receiving a variable potential for electrically adjusting the focus of said beam, and in succession down-beam, at least two associated electrodes having potentials thereon which focus in the gaps between adjacent electrodes significant main focus field components, the strength of a first of which components is controlled by adjustment of the voltage received by said focus electrode, the strength of a second of which field components spaced down-beam from said first component being relatively less than that of said first component;

each of said lens means being characterized by having addressing faces of said associated electrodes which define said second field component being so structured and disposed as to cause said second field component to be asymmetrical and effective to significantly divert said beam from its path, whereby due to the relative weakness of said second field component and the separation of said second field component from said first field component, said diverting of each of said beams results in convergence of said beams without any significant distortion of the beam and substantially independently of any beam-focusing adjustments of said first field component.

6. A gun defined by claim 5 wherein said addressing faces of said associated electrodes of said off-axis focus lens means are plano-parallel and form a gap which is angled forwardly and outwardly to form said asymmetric focusing field component.

7. The gun defined by claim 5 wherein said addressing faces of said associated electrodes of said off-axis focus lens means define a wedge-shape gap to form said asymmetric focusing field component.

8. The gun defined by claim 5 wherein said addressing faces of said associated electrode of said off-axis focus lens means have radially offset apertures effective to form said asymmetric focusing field component.

9. The gun defined by claim 5 wherein said gun is a unitized, in-line three-beam electron gun; that is, a gun generating three coplanar electron beams and having common focus electrodes for the three beams.

10. The gun defined by claim 5 wherein said gun is a three-beam gun of delta configuration having common focus electrodes for the three beams.

11. For use in a color cathode ray tube of the small neck, shadow mask-type having an extended field three-beam, inline, unitized gun; i.e., a gun generating three coplanar beams (two outer beams and an inner beam) and having common field-forming electrodes for the three beams, said electron gun producing in the tube neck an in-line cluster of red-associated, blue-associated and green-associated electron beams converged and individually focused at the screen of the tube, said gun comprising:

electron source means comprising associated cathode means and grid means for producing three separate beam crossovers, one for each electron beam; and three main focus lens means (two outer focus lens means and an inner focus lens means) situated on lens axes which are coplanar and mutually parallel and parallel to a gun center axis, said three main focus lens means respectively receiving electrons from said three beam crossovers and converging said beams and individually focusing said crossovers at a common location on the tube screen, said three focus lens means being in unitized form and having at least three unitized electrodes including a focus electrode for receiving a variable potential for electrically adjusting the focus of said beams, and in succession down-beam, at least two associated electrodes having potentials thereon which form in the gaps between adjacent electrodes significant main focus field components, the strength of a first of which components is controlled by adjustment of the voltage received by said focus electrode, the strength of a second of which field components spaced down-beam from said first components being relatively less than that of said first components;

each of said outer focus lens means being characterized by having addressing faces on said associated electrodes which define said second field component being plano-parallel and defining a gap which is angled forwardly and outwardly to cause said second field component to be asymmetrical and effective to significantly divert said beams from their paths to converge at a common point on said screen, whereby due to the relative weakness of said second field component and the separation of said second field component from said first field component, said convergence of said beams is accomplished without any significant distortion of the off-axis beams and substantially independently of any beam-focusing adjustments of said first field components of said outer focus lens means.

* * * * *